US005351793A

United States Patent [19]

Gibbs

[11] Patent Number: 5,351,793

[45] Date of Patent: Oct. 4, 1994

[54] HANDLE FOR A WHEELED SUITCASE

[75] Inventor: Richard Gibbs, Los Angeles, Calif.

[73] Assignee: Himar Sales Corp., Bel Air, Calif.

[21] Appl. No.: 58,540

[22] Filed: May 5, 1993

[51] Int. Cl.[5] ..... A45C 5/14; A45C 13/26; A45C 13/28

[52] U.S. Cl. ..... 190/115; 190/18 A; 280/37; 150/109

[58] Field of Search ..... 190/18 A, 115, 117, 190/108; 383/15; 150/107, 109; 280/37, 47.26, 47.10, DIG. 3

[56] References Cited

U.S. PATENT DOCUMENTS

| | | | |
|---|---|---|---|
| 1,658,174 | 2/1928 | Russell | 190/117 |
| 2,597,294 | 5/1952 | Connor | 280/DIG. 3 X |
| 2,631,362 | 3/1953 | Leachman | 190/109 |
| 2,721,596 | 10/1955 | Danneil | 150/106 |
| 2,777,708 | 1/1957 | Patterson | 280/37 |
| 2,798,731 | 7/1957 | Coffey | 280/37 |
| 3,197,225 | 7/1965 | Powell | 280/37 X |
| 3,319,744 | 5/1967 | Smith | 190/108 |
| 3,958,731 | 5/1976 | Riedle | 190/108 X |
| 4,418,806 | 12/1983 | Johnson | 190/111 |
| 5,105,919 | 4/1992 | Bomes et al. | 190/903 X |

FOREIGN PATENT DOCUMENTS

| | | | |
|---|---|---|---|
| 292131 | 7/1991 | Fed. Rep. of Germany | 280/47.26 |
| 2285283 | 4/1976 | France | 280/DIG. 3 |
| 2635954 | 3/1990 | France | 150/107 |

*Primary Examiner*—Sue A. Weaver

*Attorney, Agent, or Firm*—Blakely, Sokoloff, Taylor & Zafman

[57] ABSTRACT

The present invention relates to a handle for a suitcase, which has a bottom surface, a top surface, and at least four sides where a first and second sides oppose one another and a third and fourth sides oppose one another. The suitcase further includes a plurality of wheels disposed on the bottom surface to provide transitional movement of the suitcase when the suitcase is pivoted about the plurality of wheels and placed in an inclined position.

The handle comprising a first and second straps each having a first and second ends, the first and second straps being coupled to opposite sides of the suitcase. The first and second straps are adapted to have a first and second length L1 and L2 defined by the distance from the top surface of the suitcase to a middle portion of the first and second straps, the middle portion of each the first and second straps being joined during transport of the suitcase to form a substantially right triangle having an angle A between the first and second straps where the first and second lengths have a relationship corresponding approximately to the equation L1 = L2 × cosine A.

16 Claims, 1 Drawing Sheet

HANDLE FOR A WHEELED SUITCASE

BACKGROUND OF THE INVENTION

1. Field of the Invention

The present invention relates to the field of luggage, and more particularly, to the field of wheeled suitcases having handles adapted for towing of the suitcase.

2. Prior Art

Wheeled suitcases have increasingly become the luggage of choice for those jet-setting businessmen and travelers who prefer to tow their luggage from place to place instead of straining their muscles to lift and carry their luggage about. Prior the introduction of wheeled suitcases, the suitcases themselves were commonly transported by means of securing them on a separate cart or rack having wheels so that the assembly could be wheeled around as a unit. However, with the advent of wheeled suitcases, many of the disadvantages inherent in the use of wheeled carts were overcome, namely that the carts are prone towards bending due to their lightweight and often flimsy structure, that they require a means for attaching the suitcase thereto in a secure manner to prevent the suitcase from falling off and that more storage space is required to store the separable structure of the cart.

Nonetheless, the utility of wheeled suitcases is limited by the particular type and arrangement of the handle(s) used to pull the suitcase along. Specifically, most handles which are commonly used in conjunction with wheeled suitcases are constructed in the form of a rigid extension arm or "tow-bar" made out of hard plastic or metal projecting from one end of the suitcase. The tow-bar is normally affixed to the lower surface of the suitcase such that the suitcase firmly rests on top of the tow-bar when in transport, although several wheeled suitcases have tow-bars placed on the opposite, upper surface of the suitcase where the suitcase must be secured to the cart by an elastic strap or the like. The tow-bars may also be retractable through the use of telescoping tubular elements or the like for adjustment of their length and for retracting the tow-bars into a storage space within the suitcase when it is not being used.

During use, however, the tow-bar is protracted or pulled out of its storage space within the suitcase and locked into position at a desired length to accommodate the height of a particular user. With respect to those tow-bars that are horizontal when the suitcase is resting on the floor, the user raises the handle of the protracted tow-bar so as to lift the front edge of the suitcase off the floor and leave only the wheels adjacent to the rear edge of the suitcase in contact with the floor where the suitcase can be easily transported by pulling on the tow-bar. For those tow-bars that are vertical when the suitcase is at rest, the tow-bar is lowered to pivot the suitcase about the wheels mounted at its front edge.

Yet, because of the rigid mount between the tow-bar and the suitcase at the connection point and the angle at which the suitcase is placed during transport, the torque acting upon the tow-bar due to the weight of the suitcase tends to causes breakage or bending of the tow-bar especially at the connection point. Additionally, the placement of the tow-bar in the plane of either the upper surface or bottom surface of the suitcase presents an awkward configuration for towing of the suitcase due to the lack of stability caused by the connection point being placed far from the suitcase's center of mass and the substantially large angle between the extended tow-bar and the floor. Due to the fact that the tow-bar is coupled to the suitcase at only one point and its handle is quite distant from that point, it is difficult to exercise proper control over the movement of the suitcase simply by pulling on the tow-bar. The tow-bar also adds a significant amount of weight to the over-all structure and furthermore increases the cost of the suitcase due to the number of machined pieces required to implement the tow-bar and the need to provide a means for retraction or storage of the tow-bar within itself or within the suitcase.

Another type of handle which is also used in conjunction with wheeled suitcases is a single strap that is detachably connected at one end to an upper corner of the suitcase by means of a fastener. With this configuration, the strap acts much like a leash in that it can only "guides" the suitcase as it is towed since this type of handle requires all four wheels of the suitcase to remain in contact with the ground. Because these single-strap handles provide no rigid support and have no special mounting arrangement for angling the suitcase vertically or laterally, the wheeled suitcase tends to move all about as it is towed in a specific direction since no control can be exercised over the movement of the wheels.

A variation on the single-strap type handle is where the strap is of a short length and has both of its ends coupled to the top of the suitcase in much the same way as a normal suitcase handle. Although commonly used with smaller, more portable luggage, this variation has lately been used with the larger, wheeled suitcases where the user must practically lift the suitcase off the floor in order to move it forward in a controlled manner. This latter type of handle also provides no real benefit except that it can be used for both carrying and towing of the suitcase in addition to the fact that it is simple and cost effective.

Accordingly, it is an object of the present invention to provide better stability of a wheeled suitcase during its transport.

Another object of the present invention is to provide an inexpensive and lightweight handle to assist in the transport of the suitcase.

Yet another object of the present invention is to provide a handle which allows its user to angle the suitcase vertically or laterally for better control over the movement of the wheels of the suitcase.

A further object of the present invention is to provide a handle with multiple connection points so as to reduce stress placed directly on such points when the handle is utilized.

Many other advantages, factors and additional objects will become apparent to those skilled in the art upon making reference to the detailed description and the accompanying drawings in which certain embodiments incorporating the present invention are shown by way of illustration.

BRIEF SUMMARY OF THE INVENTION

The present invention recognizes the above-mentioned disadvantages of wheeled luggage in the prior art and provides a handle which overcomes the disadvantages as well as incorporates the above-mentioned advantages therein.

The present invention relates to a handle for a suitcase, which has a bottom surface, a top surface, and at least four sides where a first and second sides oppose one another and a third and fourth sides oppose one another. The suitcase further includes at least one wheel disposed on the bottom surface to provide transitional movement of the suitcase when it is pivoted about the at least one wheel and placed in an inclined position.

The handle comprising a first and second straps each having first and second ends, the first and second straps being coupled to the suitcase proximate to the third and fourth sides, respectively, with the first end of each strap coupled to the suitcase proximate to a first edge defined by an intersection between the first side and the top surface and the second end of each strap coupled to the suitcase proximate to a second edge defined by an intersection between the second side and the top surface. The first and second straps respectively have a first and second length L1 and L2 defined by the distance from the top surface of the suitcase to a middle portion of the first and second straps, the middle portion of each the first and second straps being joined during transport of the suitcase to form a substantially right triangle having an angle A between the first and second straps where the first and second lengths have a relationship corresponding approximately to the equation $L1 = L2 \times \text{cosine } A$.

BRIEF DESCRIPTION OF THE DRAWINGS

The objects, features and advantages of the present invention will become apparent from the following detailed description of the preferred embodiment in which.

DETAILED DESCRIPTION OF THE INVENTION

In the following description, numerous details such as specific materials, structures, configurations and the like are set forth in order to provide a more complete understanding of the present invention. However, it is understood by those skilled in the art that the present invention can be practiced without these specific details. In other instances, well-known elements, materials, fasteners and the like are not set forth in detail in order to avoid unnecessarily obscuring the present invention.

The present invention provides a novel handle for a wheeled suitcase. In a preferred embodiment, the handle comprises a first and second straps which differ in length and are removably attached to the suitcase in order to prevent them from being damaged during transport. Such handle, as described below, provides better control and stability of the suitcase during transportation thereof. Moreover, they are of sufficient length to enable its user to transport a suitcase without undue bending or back strain.

Figure 1:
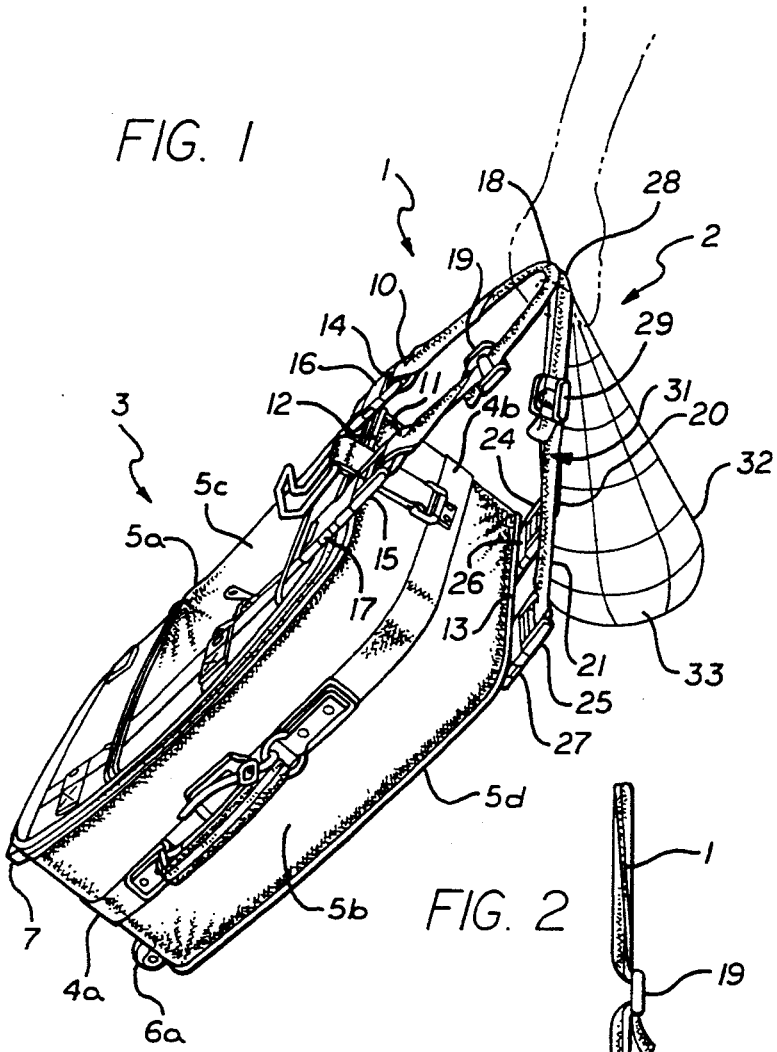
FIG. 1 is an exploded perspective view of a preferred embodiment of the present invention while in operation.

FIG. 1 illustrates a perspective view of the preferred embodiment of the present invention while in operation. According to this figure, a handle comprising a first strap 1 and a second strap 2 both of which are removably coupled to a suitcase 3. The suitcase has a bottom surface 4*a*, a top surface 4*b*, and at least four sides, wherein a first side 5*a* and a second side 5*b* are positioned opposite to one another and a third and fourth sides 5*c* and 5*d* oppose each other. The suitcase 3 further having a plurality of wheels 6 (only 6*a* is shown), although the present invention could properly function with at least one wheel, disposed on the bottom surface 4*a* proximate to the fourth side 5*d* of the suitcase. The plurality of wheels 6 provides transitional movement of the suitcase 3 in a direction generally parallel to the first and second sides 5*a* and 5*b* when the suitcase 3 is vertically pivoted about the wheels 6 and placed in an inclined position. A rest member 7 is further disposed on the bottom surface 4*a* proximate to the third side 5*c* to provide stability when the suitcase 3 is placed in an upright position.

The first strap 1, made of lightweight nylon, leather or other similar material thereby not susceptible to breakage when excessive force is exerted thereon. The first strap includes a first and second ends 10 and 11 each of which are proximately coupled to the third side 5*c* of the suitcase. The first end 10 is coupled to the suitcase 3 proximate to a first edge 12 which is defined by an intersection between the first side 5*a* and the top surface 4*b*. The second end 11, on the other hand, is coupled to the suitcase 3 proximate to a second edge 13 defined by an intersection between the second side 5*b* and the top surface 4*b*. Each of the first and second ends 10 and 11 are coupled to a fastener 14 and 15, which comprise clasps, dips, clamps or hooks. Both fasteners 14 and 15 are inserted into corresponding receiving members 16 and 17 disposed on the top surface 4*b* of the suitcase 3 thereby providing easy removability of the first strap 1 from the suitcase 3.

The first strap 1 further includes a first length adjustment member 19 for adjusting a length "L1" of the first strap. The length "L1" is defined by the distance from the top surface 4*b* of the suitcase to a middle portion 18 of the first strap when the first and second ends 10 and 11 are coupled to the suitcase 3 by the interconnection between the fasteners 14 and 15 and the corresponding receivers 16 and 17. The length adjustment member 19 is well known to one skilled in the art and comprise such elements as sliding clamps and buckles.

Similar to the first strap 1, the second strap 2 also includes a first and second ends 20 and 21 which are coupled to the suitcase by interconnecting a plurality of fasteners 24 and 25 and a plurality of corresponding receiving members 26 and 27. The second strap 2 is coupled proximate to the fourth side 5*d* of the suitcase with the first end 20 coupled to the suitcase 3 near the first edge 12 and the second end 21 coupled to the suitcase 3 proximate to the second edge 13. The second strap 2 also includes a second length adjustment member 29, similar to the first adjustment member 19 to vary the length of the second strap 2 "L2". Such length "L2" is defined by the distance from the top surface 4*b* of the suitcase to a middle portion 28 of the second strap 2.

The first and second straps of the suitcase handle are engaged about the fastening middle portion 18 and 28 of each strap during transport of the suitcase by a fastening device such as a corresponding hook and loop fastening member, clip, clamp or hook. The middle portion of each the first and second straps 18 and 28 are joined during transport of the suitcase to form a substantially right triangle having an angle A between the first and second straps 1 and 2 so that the first and second lengths L1 and L2 have a relationship corresponding approximately to the equation $L1 = L2 \times \text{cosine } A$ as shown in FIG. 3.

The coupling between the first and second ends of the second strap and the top surface 4*a* of the suitcase forms an aperture 31 between the middle portion 28 of the second strap and the top surface 4*b*. A webbing 32 may be coupled to a perimeter of the second strap 2 to define a reception cavity 33 having an opening substantially corresponding to the aperture 31. Various objects, such as passports, wallets and the like can be stored within the reception cavity 33 and quickly and conveniently removed.

Figure 2:
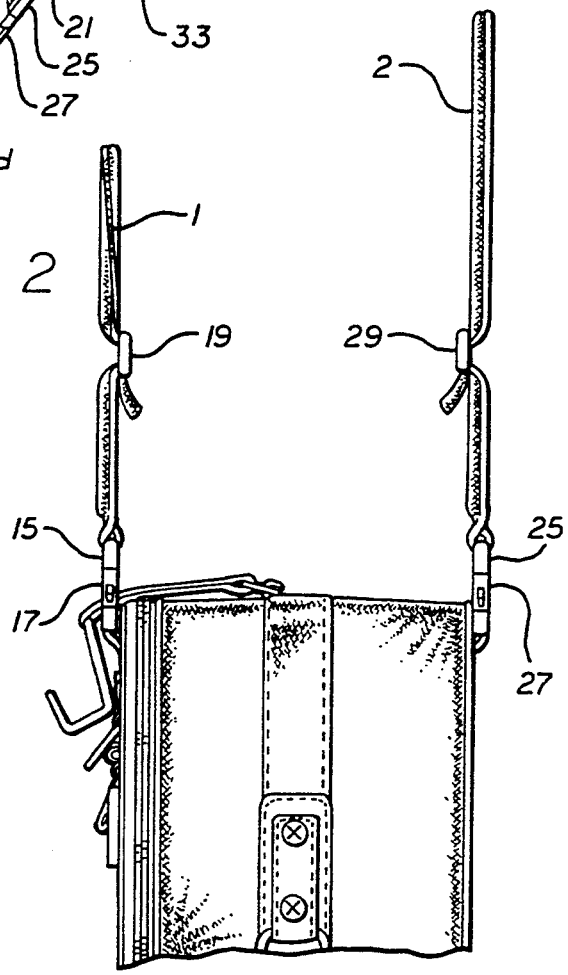
FIG. 2 is a side view of the preferred embodiment of a preferred embodiment as shown in FIG. 1 when the suitcase is placed in an upright position.

FIG. 2 is a side view of the preferred embodiment of the present invention when the suitcase 3 is in an upright position. As clearly shown in this figure, the second strap 2 is visibly longer than the first strap 1 in order to provide better stability and control of the suitcase 3 during transport by allowing the user to angle the suitcase vertically, or even laterally, as shown in FIG. 1. The straps 1 and 2 are coupled proximate to the suitcase 3 through an interlocking of the plurality of fasteners 14, 15, 24 and 25 and receivers 16, 17, 26 and 27 respectively. In viewing FIG. 2, only fasteners 15 and 25 and receivers 17 and 27 are shown. The first strap and second straps 1 and 2 can be adjusted to a specific length in accordance with the height and comfort of the user through the first and second adjustment members 19 and 29.

Figure 3:
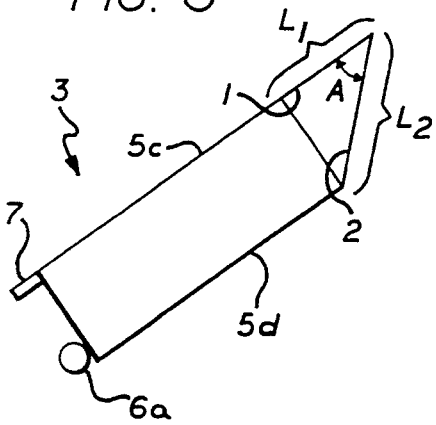
FIG. 3 is a side view of the present invention illustrating the geometrical orientation of the present invention.

FIG. 3 illustrates a side view of the present invention from either one of the first and second sides 5*a* and 5*b* of the suitcase when the present invention is in operation. The first strap 1 extends outward from the top surface substantially along a plane encompassing the third side 5*c*. The second strap 2, however, extends outward from the top surface 4*b* substantially along a diagonal axis extending from the fourth side 5*d* to the third side 5*c* such that when the middle portions of the first and second straps 18 and 28 are held proximate to one another during transport. As discussed above, during transport, a substantially right triangle is formed between the first strap 1, the second strap 2 and the top surface 4*b* of the suitcase 3 such that there exists the angle A between the first and second strap 1 and 2. As a result, the length of the first and/or second strap can be adjusted to provide maximum stability and control for persons or different height and other physical characteristics While the invention has been described in conjunction with the preferred embodiment, it is evident that numerous alternatives, variations and uses will be apparent to those skilled in the art in light of the foregoing description. Such alternatives are possible without departing from the spirit of the invention. For example, the handle may comprise a single strap having at least one attachment point at both the third and fourth sides of the suitcase, where the portion of the strap attached to the fourth side is longer than the portion coupled proximate to the third side. In addition, the handle may be attached to the first and second sides of the suitcase having a similar construction as the preferred embodiment, but having the suitcase wheel(s) is disposed on the bottom side proximate to either the first or second side. Moreover, the first and second straps may be designed having a fixed length without length adjustment members connected therewith. Therefore, the invention should be measured in terms of the claims which follow.

I claim:

1. A handle for a suitcase, the suitcase having a bottom surface, a top surface, and at least first, second, third and fourth sides where the first and second sides oppose one another and the third and fourth sides oppose one another, the suitcase further having a plurality of wheels disposed on the bottom surface to provide transitional movement of the suitcase when the suitcase is placed in an inclined position by pulling the handle in a direction generally perpendicular to the third and fourth side so that the suitcase tilts toward the fourth side, the handle comprising:

a first and second strap each having a first and second end, the first and second straps being coupled to opposite sides of the suitcase;

first means for attaching the first and second ends of the first strap to the suitcase, said first attaching means being proximately coupled to the third side of the suitcase;

second means for attaching the first and second ends of the second strap to the suitcase, said second attaching means being proximately coupled to the fourth side of the suitcase; and the first and second straps adapted to have a first length L1 and a second length L2, respectively defined by the distance from the top surface of the suitcase to a middle portion of the first and second straps, the middle portion of each the first and second straps being joined during transport of the suitcase to form a substantially right triangle having an angle A between the first and second straps where the first and second lengths have a relationship corresponding approximately to the equation $L1 = L2 \times \text{cosine } A$.

2. The suitcase handle of claim 1, wherein the first step extends outward from the stop surface substantially along a plane encompassing the third side and the second strap extends outward from the top surface substantially along a diagonal axis extending from the fourth side to the third side such that when the middle portions of the first and second straps are held proximate to one another during transport a substantially right triangle is formed between the first strap, the second strap and the top surface as viewed from either one of the first and second sides.

3. The suitcase handle of claim 1, wherein the first and second ends of the first strap being coupled to the suitcase proximate to a first edge defined by an intersection between the third side and the top surface and the first and second ends of the second strap being coupled to the suitcase proximate to a second edge defined by an intersection between the fourth side and the top surface.

4. The suitcase handle of claim 3, wherein the first attaching means comprises a first pair of fasteners coupled to the ends of the first strap, said first pair of fasteners being attached to a corresponding pair of receiving members proximately coupled to the first edge of the suitcase for reception of the first pair of fasteners.

5. The suitcase handle of claim 4, wherein the second attaching means comprises a second pair of fastener coupled to the ends of the second strap, wherein said second pair of fasteners are attached to a corresponding pair of receiving members proximately coupled to the second edge of the suitcase for reception of the second pair of fasteners.

6. The suitcase handle of claim 1, wherein the coupling between the first and second ends of the second strap and the top surface of the suitcase forms an aperture between the first strap and the top surface, the suitcase handle further comprising webbing coupled to a perimeter of the second strap to define a reception cavity having an opening substantially corresponding to the aperture for the storage of objects within the reception cavity.

7. The suitcase handle of claim 1, wherein the suitcase handle further comprises engagement means for engaging the first and second straps about the middle portion of each strap during transport of the suitcase, the engagement means comprising a fastener.

8. The suitcase handle of claim 1, wherein the first and second straps comprise length adjustment members for adjustment of the first and second lengths, respectively.

9. A handle for a suitcase, the suitcase having a bottom surface, a top surface, and at least first, second, third and fourth sides where the first and second sides oppose one another and the third and fourth sides oppose one another, the suitcase further having at least one wheel disposed on the bottom surface proximate to the second side in order to provide transitional movement of the suitcase in a direction generally perpendicular to the first and second sides when the suitcase is placed in an inclined position by pulling the handle in the direction generally perpendicular to the first and second side so that the suitcase tilts toward the second side, the handle comprising:

a first and second strap each having a first and second end, the first and second end of the first strap being coupled to the suitcase proximate to a first edge defined by an intersection between the first side and the top surface,the first and second end of the second strap being coupled to the suitcase proximate to a second edge defined by an intersection between the second side and the top surface;

first means for attaching the first and second ends of the first strap to the first edge of the suitcase;

second means for attaching the first and second ends of the second strap to the second edge of the suitcase;

the first strap extending outward from the top surface substantially along a plane encompassing the first side and the second strap extending outward from the top surface substantially along a diagonal axis extending from the second side to the first side; and the first and second straps having first and second lengths respectively defined by the distance from the top surface of the suitcase to a middle portion of the first and second straps, with the first and second lengths being selected so that the middle portion of the second strap is adjacent to the middle portion of the first strap in the plane encompassing the first side to define a substantially right triangle between the first strap, the second strap and the top surface as viewed from either one of the third and fourth sides when the suitcase is placed in the inclined position for transport.

10. The suitcase handle of claim 9, wherein the substantially right triangle formed between the first strap, the second strap and the top surface comprises an angle A between the first and second straps and the first and second lengths have a relationship corresponding approximately to the equation $L1 = L2 \times \text{cosine } A$.

11. The suitcase handle of claim 9, wherein the coupling between the first and second ends of the first strap and the top surface of the suitcase forms an aperture between the first strap and the top surface, the suitcase handle further comprising webbing coupled to a perimeter of the first strap to define a reception cavity having an opening corresponding to the aperture for the storage of objects within the reception cavity.

12. The suitcase handle of claim 9, wherein the suitcase handle further comprises engagement means for engaging the first and second straps about the middle portion of each strap during transport of the suitcase, the engagement means comprising a fastener.

13. The suitcase handle of claim 9, wherein the first attaching means comprises a first pair of fasteners coupled to the ends of the first strap, said first pair of fasteners being attached to a corresponding pair of receiving members proximately coupled to the first edge of the suitcase for reception of the first pair of fasteners.

14. The suitcase handle of claim 13, wherein the second attaching means comprises a second pair of fastener coupled to the ends of the second strap, wherein said second pair of fasteners are attached to a corresponding pair of receiving members proximately coupled to the second edge of the suitcase for reception of the second pair of fasteners.

15. The suitcase handle of claim 9, wherein the first and second straps comprise length adjustment members for adjustment of the first and second lengths, respectively.

16. A handle for a suitcase, the suitcase having a bottom surface, a top surface, and a plurality of sides, the suitcase further having at least one wheel disposed on the bottom surface proximate to a first side of the plurality of sides in order to provide transitional movement of the suitcase when the suitcase is placed in an inclined position by pulling the handle in a direction generally perpendicular to the first side so as to cause the first side to partially face downward, the handle comprising:

a first and second strap each having a first and second end;

first means for coupling the first and second ends of the first strap to a first edge of the suitcase, said first edge being an intersection between the first side and the top surface;

second means for coupling the first and second ends of the second strap to a second edge of the suitcase, said second edge being an intersection between the second side being opposite said first side and the top surface; and the first and second straps having first and second lengths respectively defined by the distance from the top surface of the suitcase to a middle portion of the first and second straps, with the first and second lengths being selected so that the middle portion of the second strap is adjacent to the middle portion of the first strap in the plane encompassing the side to define a substantially right triangle between the first strap, the second strap and the top surface as viewed from a direction perpendicular to the first and second sides when the suitcase is placed in the inclined position for transport.

* * * * *

UNITED STATES PATENT AND TRADEMARK OFFICE

CERTIFICATE OF CORRECTION

PATENT NO. : 5,351,793

DATED : October 4, 1994

INVENTOR(S) : Gibbs

It is certified that error appears in the above-identified patent and that said Letters Patent is hereby corrected as shown below:

In column 4, at line 26 change "dips" to -- clips --

In column 6, at line 31 change "step" to -- strap --

Signed and Sealed this

Twentieth Day of June, 1995

Bruce Lehman

*Attest:*

BRUCE LEHMAN

*Attesting Officer*

*Commissioner of Patents and Trademarks*